US009512594B2

(12) United States Patent
Callewaert

(10) Patent No.: US 9,512,594 B2
(45) Date of Patent: Dec. 6, 2016

(54) INTERCONNECTING MEMBER FOR A SAND OR SOIL BAG STRUCTURE

(71) Applicant: Mike Callewaert, Surrey (CA)

(72) Inventor: Mike Callewaert, Surrey (CA)

(73) Assignee: Callewaert Intellectual Property Inc., Surrey (CA)

( * ) Notice: Subject to any disclaimer, the term of this patent is extended or adjusted under 35 U.S.C. 154(b) by 0 days.

(21) Appl. No.: 14/773,274

(22) PCT Filed: Mar. 6, 2014

(86) PCT No.: PCT/CA2014/050187

§ 371 (c)(1),
(2) Date: Sep. 4, 2015

(87) PCT Pub. No.: WO2014/134735

PCT Pub. Date: Sep. 12, 2014

(65) Prior Publication Data

US 2016/0017566 A1 Jan. 21, 2016

Related U.S. Application Data

(60) Provisional application No. 61/773,800, filed on Mar. 6, 2013.

(51) Int. Cl.

| | |
|---|---|
| ***E02D 29/02*** | (2006.01) |
| ***E02B 3/12*** | (2006.01) |
| *E02B 3/10* | (2006.01) |

(52) U.S. Cl.

CPC ..... *E02D 29/0291* (2013.01); *E02B 3/127* (2013.01); *E02D 29/025* (2013.01); *E02D 29/0266* (2013.01); *E02B 3/108* (2013.01)

(58) Field of Classification Search

CPC ... E02D 29/02; E02D 29/0291; B65D 33/00; E02B 3/12; E02B 3/108

See application file for complete search history.

(56) References Cited

U.S. PATENT DOCUMENTS 3,922,832 A * 12/1975 Dicker ..... C04B 40/0608 405/107
7,083,364 B2 8/2006 Kim
7,452,164 B2 11/2008 Kim
7,922,426 B2 4/2011 Thomson (Continued)

FOREIGN PATENT DOCUMENTS

CA 2572008 6/2008
KR 20140123351 A * 10/2014

OTHER PUBLICATIONS

WIPO, International Searching Authority, "International Search Report" mailed Jun. 19, 2014 in International Patent Application No. PCT/CA2014/050187, 3 pages.

(Continued)

*Primary Examiner* — Frederick L Lagman
(74) *Attorney, Agent, or Firm* — Cameron IP

(57) ABSTRACT

An interconnecting member for a sand or soil bag comprises a plate having a first side and a second side. There is a plurality of projections on the first side of the plate and a plurality of projections on the second side of the plate. There is also a pair of serrations on the first side of the plate. The serrations each include a plurality of teeth arranged in a row and extending away from the plate in a first direction, and an end tooth at one end of the row which extends away from the plate in a second direction which is opposite of the first direction.

12 Claims, 7 Drawing Sheets

(56) References Cited

U.S. PATENT DOCUMENTS

| | | | | |
|---|---|---|---|---|
| 8,371,772 | B2 | 2/2013 | Chang | |
| 8,596,927 | B2 * | 12/2013 | Thomson | E02B 3/127 405/284 |
| 9,175,453 | B2 * | 11/2015 | Alfreds | E02D 17/20 |
| 2006/0257212 | A1 | 11/2006 | Kim | |
| 2007/0110522 | A1 | 5/2007 | Kim | |
| 2009/0304458 | A1 | 12/2009 | Chang | |
| 2011/0110728 | A1 * | 5/2011 | Kim | E02D 29/0225 405/284 |
| 2012/0027528 | A1 | 2/2012 | Alfreds | |
| 2014/0369768 | A1 * | 12/2014 | Blanks | E02D 5/16 405/279 |

OTHER PUBLICATIONS

WIPO, International Searching Authority, "Written Opinion" mailed Jun. 19, 2014 in International Patent Application No. PCT/CA2014/050187, 4 pages.

* cited by examiner

INTERCONNECTING MEMBER FOR A SAND OR SOIL BAG STRUCTURE

BACKGROUND OF THE INVENTION

1. Field of the Invention

The present invention relates to sand or soil bag structures and, in particular, to an interconnecting member for interconnecting sand or soil bags in a sand or soil bag structure.

2. Description of the Related Art

U.S. Pat. No. 7,452,164 which issued on Nov. 18, 2008 to Kim and which is a continuation-in-part of U.S. patent application Ser. No. 10/842,620, which issued to U.S. Pat. No. 7,083,364 on Aug. 1, 2006 to Kim, discloses a retaining wall structure built of wall-building units such as sand or soil bags or hardenable building units such as clay bricks. The retaining wall structure has interconnecting members placed between adjacent courses of units to attach the adjacent courses to one another. The interconnecting members are plates having projections on both sides which protrude into the wall-building units of the adjacent courses. Sheets of geogrid preferably extend from between some of the courses of wall-building units into the fill retained by the wall-building units. Projections on the interconnecting members protrude through holes in the geogrid sheet, anchoring the wall side to the reinforced soil structure.

U.S. Pat. No. 8,371,772 which issued on Feb. 12, 2013 to Chang discloses a retaining wall structure which includes a number of bag units piled to form a wall and interconnecting units disposed between vertically adjacent bag units. The interconnecting units each has a plate and protrusions protruding from upper and lower sursides of the plate. A reinforcing layer is provided between the plate of a relative interconnecting unit and a relative bag unit. The reinforcing layer is selected from cement or adhesive (such as glue). The reinforcing layer between the plate of the interconnecting unit and the bag unit is used to enhance the entire stability of the retaining wall adapted for operation in different circumstances.

United States Patent Application Publication Number 2012/0027528 which published on Feb. 2, 2012 in the name of Alfreds discloses retaining wall systems and methods of making retaining wall systems. In one embodiment, the retaining wall system includes a first horizontally-extending course of sand or soil bags and a second horizontally-extending course of sand or soil bags positioned vertically adjacent to the first course of sand or soil bags. An interconnecting member attaches the first course of sand or soil bags to the second course of sand or soil bags. The interconnecting member has an upper side and a lower side. At least one of the upper side and the lower side has a first projection that includes a notch therein to engage geogrid.

SUMMARY OF THE INVENTION

It is an object of the present invention to provide an improved interconnecting member for interconnecting sand or soil bags in a sand or soil bag structure.

It is another object of the present invention to provide improved sand or soil bag structures including, but not limited to, artificial slopes, bridge abutments, dams, dykes, retaining walls and seawalls.

There is accordingly provided an interconnecting member for a sand or soil bag comprising a plate having a first side and a second side. There is a projection on the first side of the plate and a projection on the second side of the plate. There is a serration including a plurality of teeth arranged in a row on the first side of the plate. The plurality of teeth extends away from the plate in a first direction. There is a tooth on the first side of the plate which extends away from the plate in a second direction which is opposite the first direction.

There is also provided an interconnecting member for a sand or soil bag comprising a plate having a first side and a second side. There is a plurality of projections on the first side of the plate and a plurality of projections on the second side of the plate. There is a pair of spaced-apart serrations on the first side of the plate. The serrations each include a plurality of teeth arranged in a row and extending away from the plate in a first direction. The serrations also each include an end tooth disposed at an end of the row and extending away from the plate in a second direction which is opposite the first direction.

The projections on the first side of the plate may be hollow and the projections on the second side of the plate may be hollow. Each said projection in the plurality of projections on the first side of the plate may be cone shaped. The plurality of projections on the first side of the plate may be aligned in a single row and may be disposed between the pair of spaced-apart serrations. Each said projection in the plurality of projections on the second side of the plate may be cone shaped. The plurality of projections on the second side of the plate may be aligned in two parallel rows. The teeth may be wedge shaped and the end tooth may be wedge shaped. The plate may be elongate. The serrations may each extend transversely along the first side of the plate. The plurality of projections on the first side of the plate may be aligned in a single row along a longitudinal axis of the plate. The plurality of projections on the second side of the plate may be aligned in two parallel rows aligned parallel to the longitudinal axis of the plate.

There is further provided a sand or soil bag structure comprising a first sand or soil bag, a second sand or soil bag and an interconnecting member disposed between the first sand or soil bag and the second sand or soil bag. The interconnecting member includes a plate with a first side and a second side. There is a first projection on the first side of the plate and a second projection on the second side of the plate. There is a plurality of teeth on the first side of the plate. The plurality of teeth extends away from the plate in a first direction. There is a tooth on the first side of the plate which extends away from the plate in a second direction which is opposite the first direction. The first projection on the first side of the plate engages the first sand or soil bag and the second projection on the second side of the plate engages the second sand or soil bag. There may be a geogrid which engages the tooth on the first side of the plate. The plurality of teeth on the first side of the plate may be arranged in a row. The tooth may be aligned with the plurality of teeth arranged in a row.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
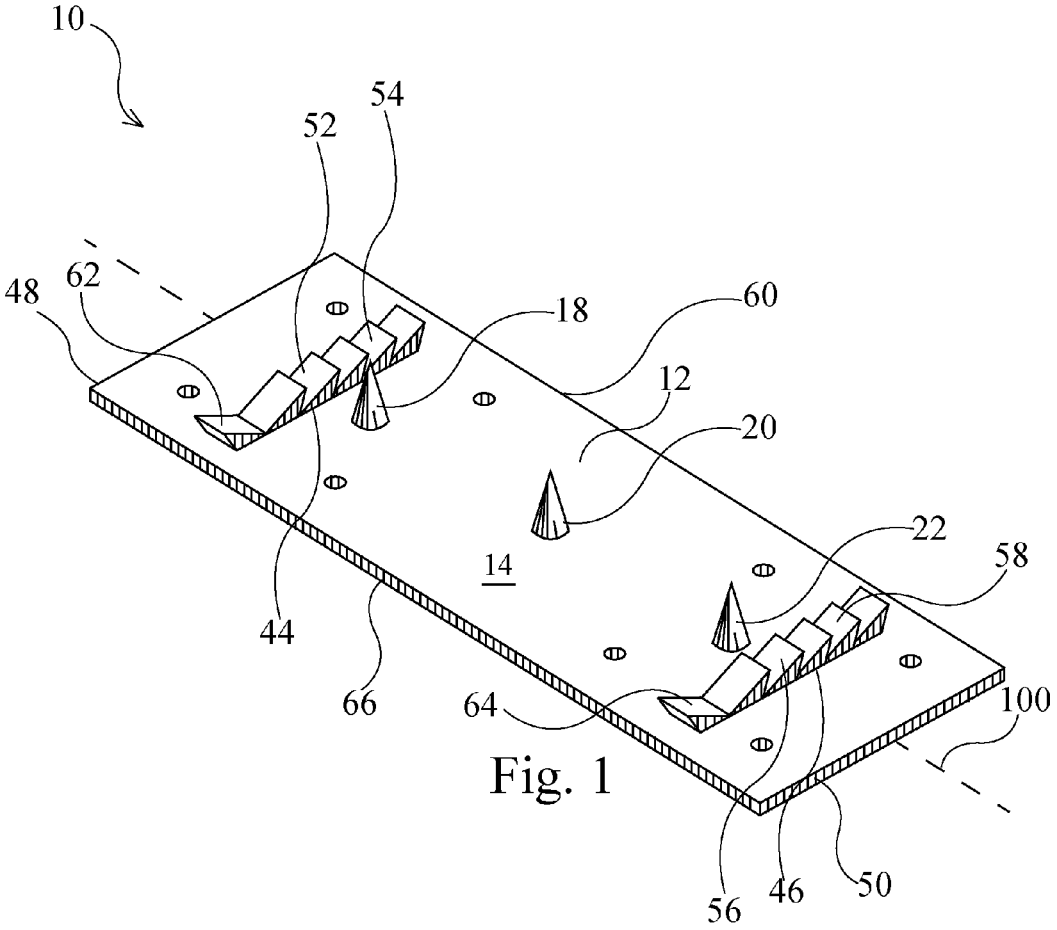
FIG. 1 is a top perspective view of an improved interconnecting member for a sand or soil bag structure.
Figure 2:
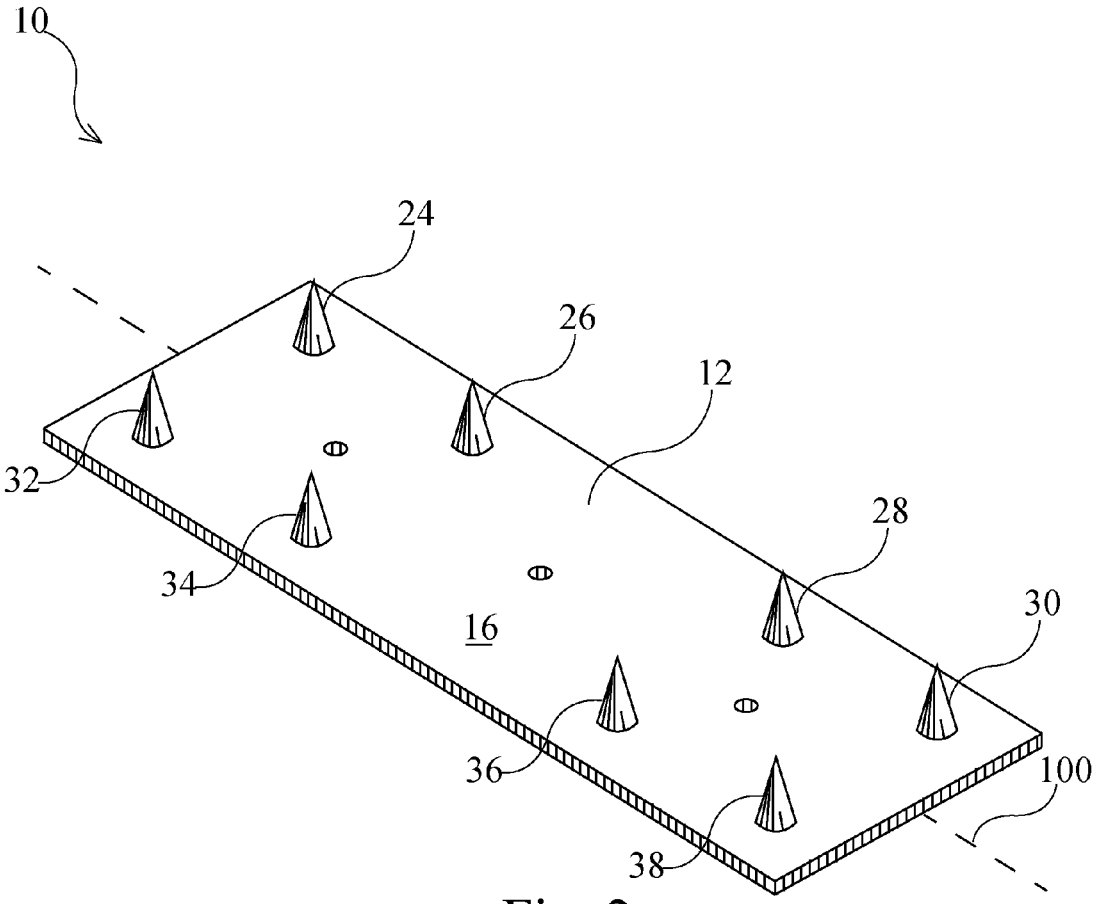
FIG. 2 is a bottom perspective view of the interconnecting member of FIG. 1.
Figure 3:
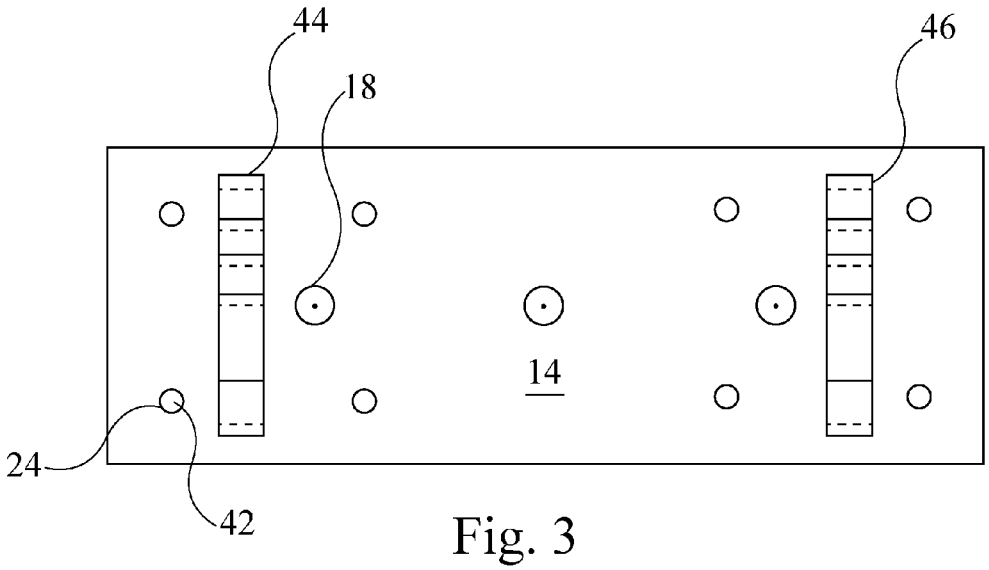
FIG. 3 is a top plan view of the interconnecting member of FIG. 1.
Figure 4:
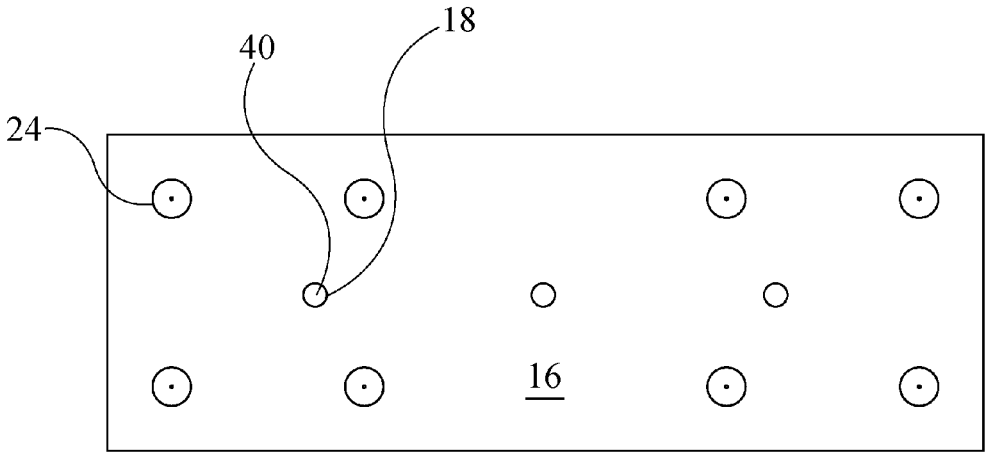
FIG. 4 is a bottom plan view of the interconnecting member of FIG. 1.
Figure 5:
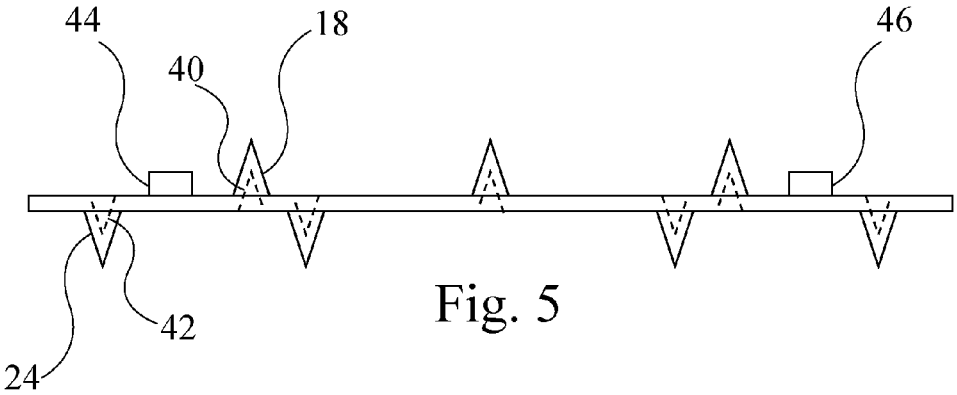
FIG. 5 is a side elevation view of the interconnecting member of FIG. 1.
Figure 6:
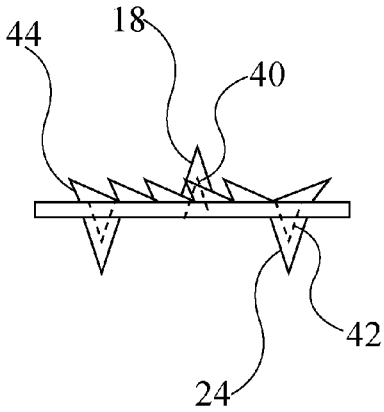
FIG. 6 is an end view of the interconnecting member of FIG. 1.
Figure 7:
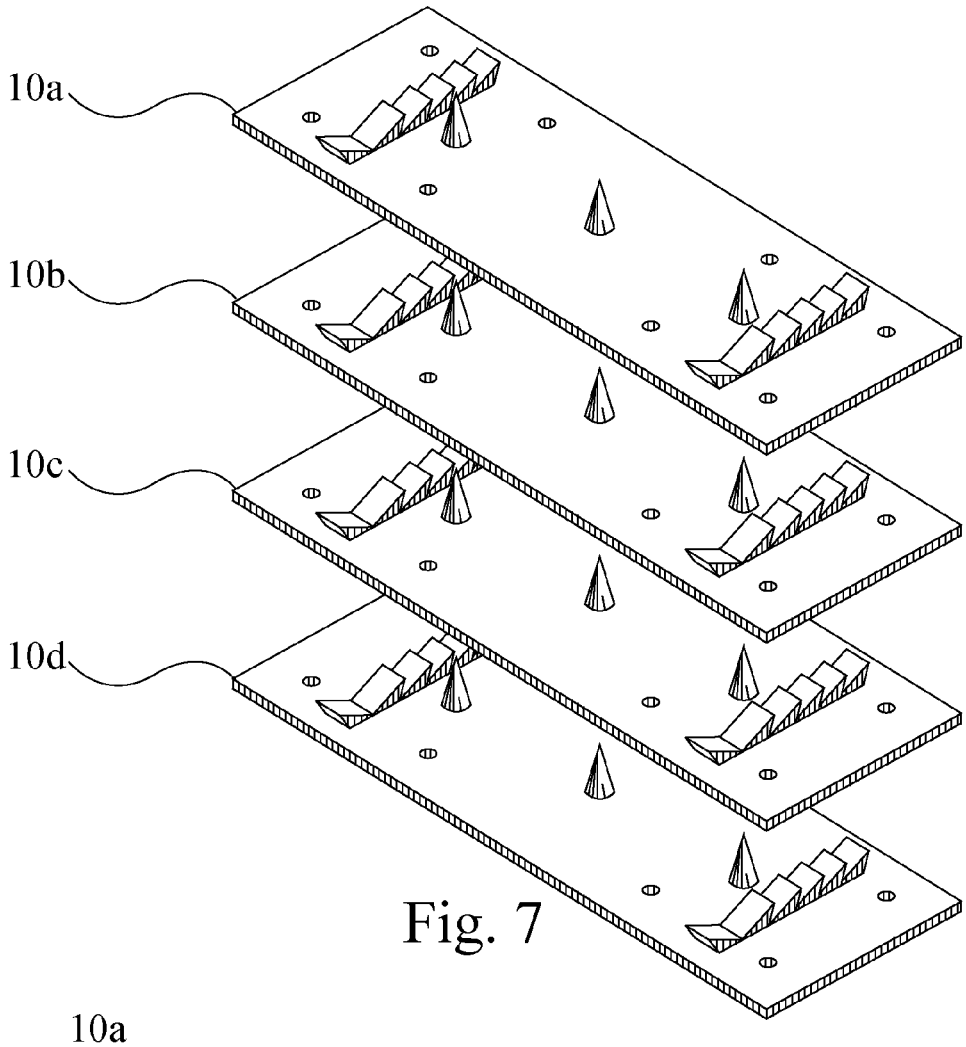
FIG. 7 is a perspective view showing a plurality of interconnecting members similar to the type shown in FIG. 1 being stacked together.
Figure 8:
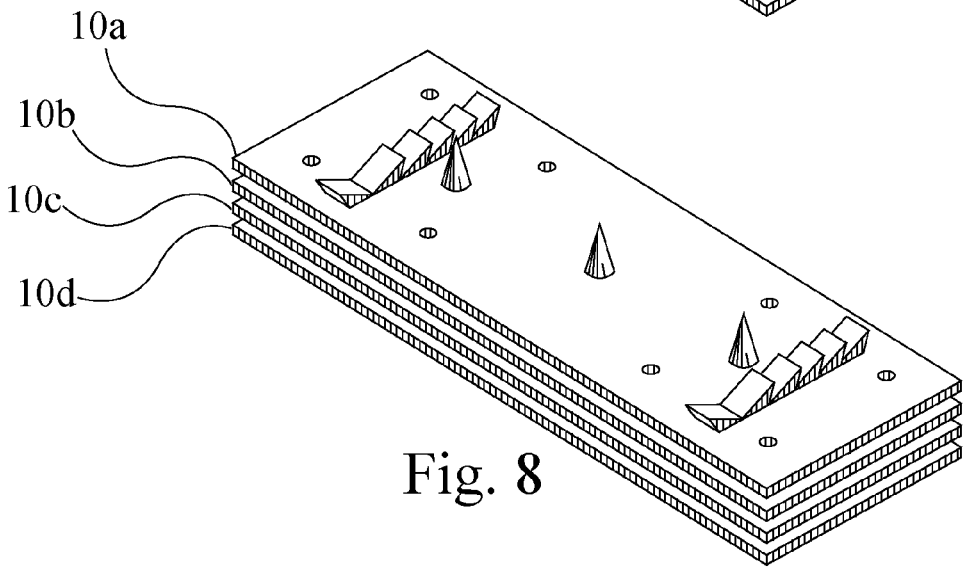
FIG. 8 is a perspective view showing a plurality of interconnecting members similar to the type shown in FIG. 1 stacked together.

Referring to the drawings and first to FIGS. 1 and 2, an improved interconnecting member 10 for interconnecting sand or soil bags in a sand or soil bag structure is shown. The interconnecting member 10 includes an elongate plate 12 that has a first side 14 which is shown in FIG. 1 and a second side 16 which is shown in FIG. 2. The first side 14 of the plate 12 is a top side of the plate and includes a plurality of projections 18, 20 and 22. The second side 16 of the plate 12 is a bottom side of the plate and also includes a plurality of projections 24, 26, 28, 30, 32, 34, 36 and 38. The projections are hollow cones, in this example, with open bottoms adjacent the plate 12. FIGS. 3 to 6 show exemplar hollows 40 and 42 of respective projections 18 and 24. The hollow projections allow the interconnecting member 10 to be tightly stacked with like interconnecting members because the projections of one interconnecting member are received by corresponding hollows of another interconnecting member. FIGS. 7 and 8 show the stacking of a plurality of like interconnecting members 10*a*, 10*b*, 10*c* and 10*d*.

The interconnecting member 10 as thus far described is generally conventional. However, as best shown in FIG. 1, the interconnecting member 10 disclosed herein is further provided with serrations 44 and 46 on the first side 14 of the plate 12. In this example, the serrations 44 and 46 are adjacent opposite end edges 48 and 50 of the plate 12. The serrations each include a plurality of teeth, for example, teeth 52 and 54 shown for a first one of the serrations 44 and teeth 56 and 58 shown for a second one of the serrations 46. The teeth are arranged in rows and are generally wedge shaped, in this example, and extend away from the plate 12 in a first direction towards a first longitudinal edge 60 of the plate 12 in this example. The serrations also each include a respective end tooth 62 and 64 which is also generally wedge shaped but extends away from the plate 12 in a second direction towards a second longitudinal edge 66 of the plate 12 in this example. The first direction and second direction are opposite of each other. In other examples, the serrations may only include a plurality of teeth extending away from the plate in the first direction and there may be a tooth remote of the serrations which extends away from the plate in the second direction. In still other examples, there may not be a serration but rather a plurality of spaced-apart teeth extending away from the plate in the first direction.

Figures 9A, 9B:
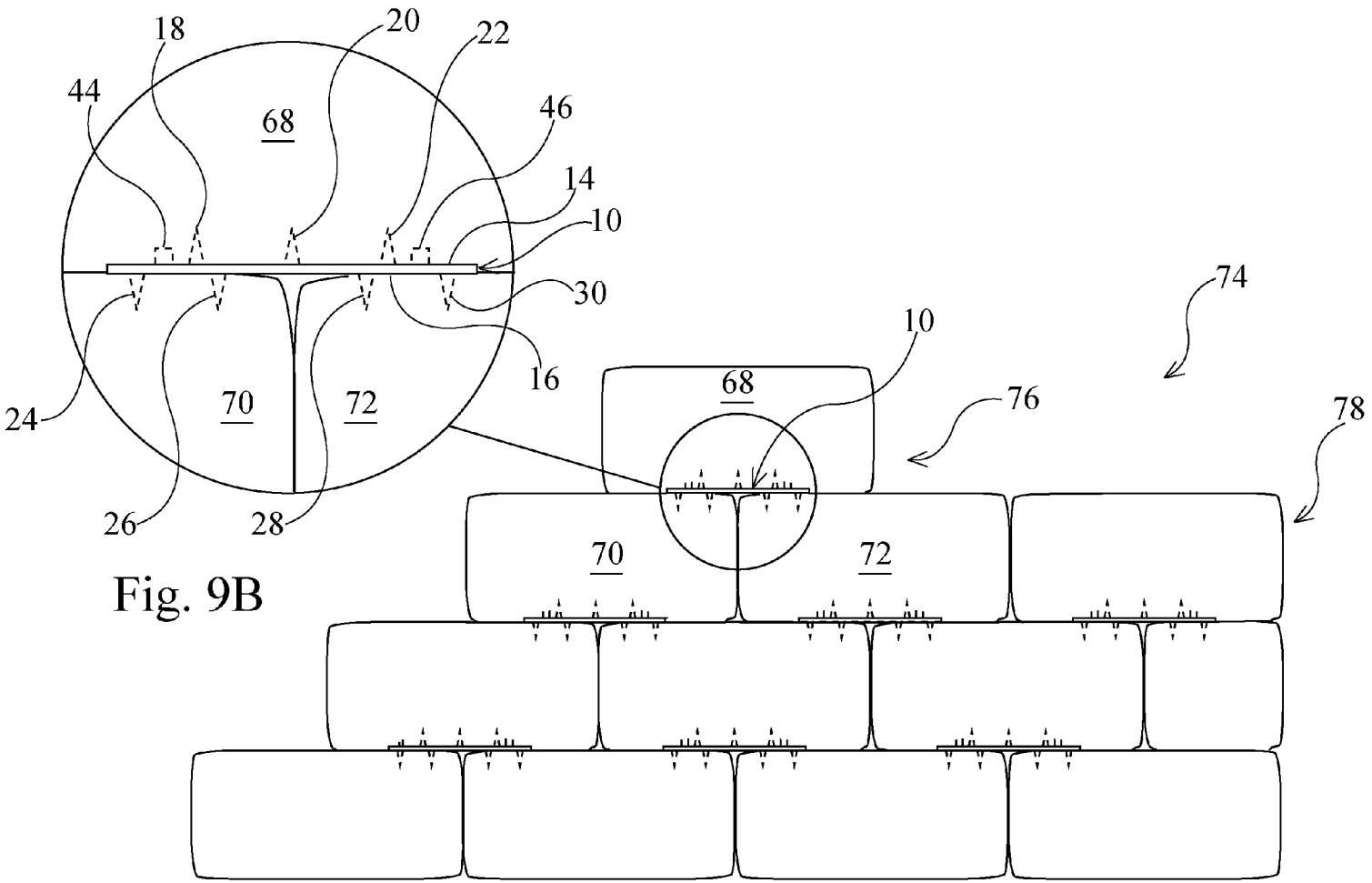
FIG. 9A is a front elevation view of a sand or soil bag structure constructed using the interconnecting member of FIG. 1.
FIG. 9B is an enlarged view of the interconnecting member of FIG. 1 as shown in FIG. 9A.
Figure 10:
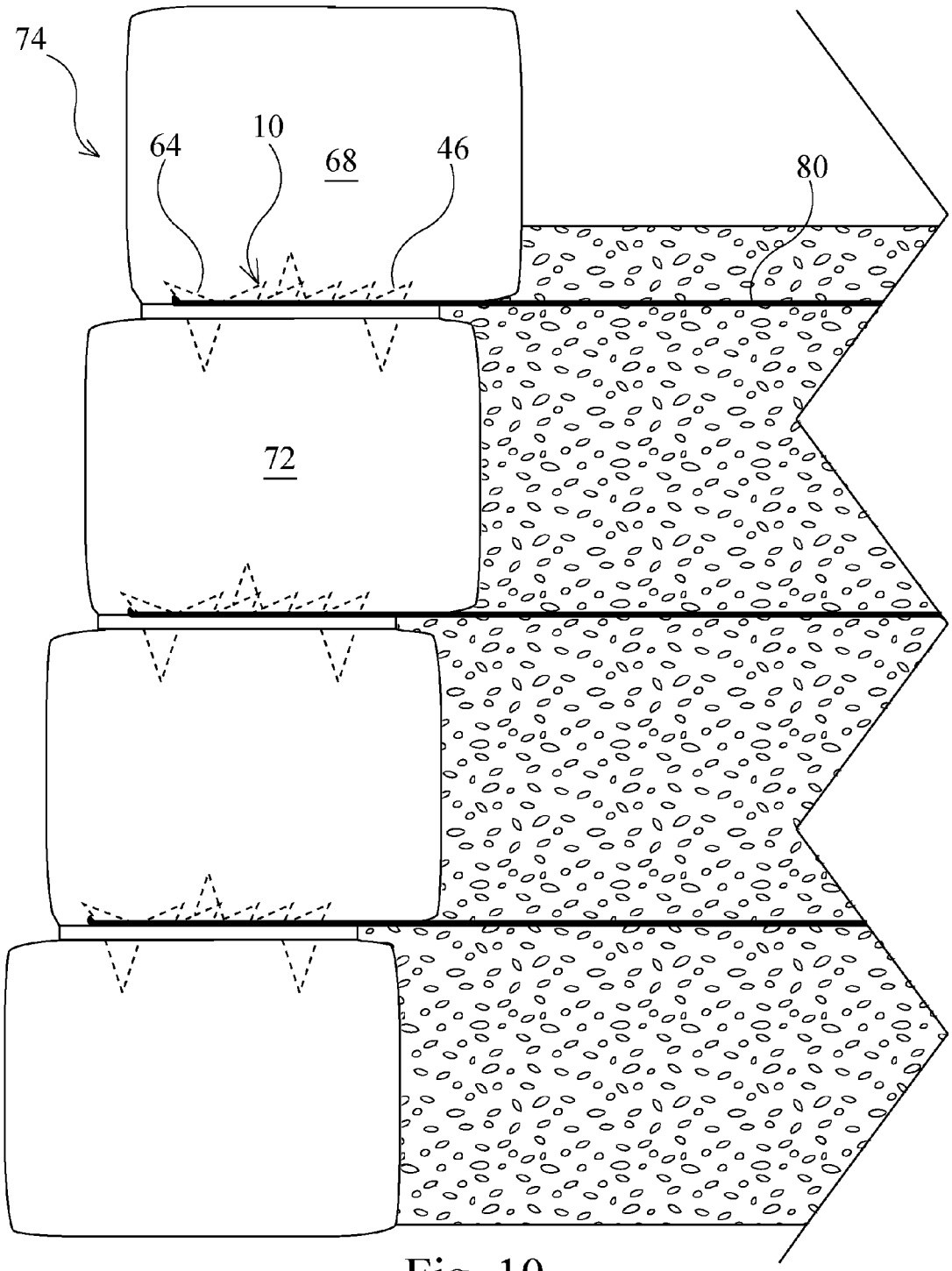
FIG. 10 is a side elevation view of a sand or soil bag structure constructed using the interconnecting member of FIG. 1.

FIGS. 9A and 9B show the interconnecting member 10 interconnecting sand or soil bags 68, 70 and 72 in a sand or soil bag structure 74. The plurality of projections 18, 20 and 22 on the first side 14 of the plate 12 engage the sand or soil bag 68 on an upper course 76 of the sand or soil bag structure 74. Respective ones of the plurality of projections on the second side 16 of the plate 12, for example projections 24, 26, 28 and 30, engage respective sand or soil bags 70 and 72 in a lower course 78 of the sand or soil bag structure 74. It will be understood by a person skilled in the art that the terms upper course and lower course as used herein refer to the position of the course relative to the interconnecting member. The serrations 44 and 46 minimize the potential of wall creep after installation of a sand or soil bag structure installation where surcharge, hydrostatic pressure or natural movement may otherwise cause bulging or structural failure. The respective end tooth 56 and 58 of each of the serrations 44 and 46 allow a geogrid reinforcement 80 to directly engage the interconnecting member 10 as shown in FIG. 10 for end tooth 64 of serration 46.

The interconnecting member 10 shown in FIGS. 1 to 6 has a rectangular shaped plate. There are three hollow cone shaped projections 18, 20 and 22 on the first side 14 of the plate 12 and eight hollow cone shaped projections 24, 26, 28, 30, 32, 34, 36 and 38 on the second side 16 of the plate 12. The projections on the first side of the plate are aligned in a single row along a longitudinal axis 100 of the plate and are disposed between the spaced-apart serrations 44 and 46 which extend transversely along the first side of the plate. The projections on the second side of the plate are arranged in two parallel rows of four projections which are aligned parallel to the longitudinal axis 100 of the plate. It will however be understood by a person skilled in the art that alternative shapes and configurations may be used.

It will also be understood by a person skilled in the art that many of the details provided above are by way of example only, and are not intended to limit the scope of the invention which is to be determined with reference to the following claims.

What is claimed is:

1. An interconnecting member for a sand or soil bag comprising:

a plate having a first side and a second side;

a plurality of projections on the first side of the plate;

a plurality of projections on the second side of the plate; and a pair of spaced-apart serrations on the first side of the plate, wherein the serrations each include a plurality of teeth arranged in a row and extending away from the plate in a first direction, and an end tooth disposed at an end of the row and extending away from the plate in a second direction which is opposite the first direction.

2. The interconnecting member as claimed in claim 1 wherein the projections on the first side of the plate are hollow and the projections on the second side of the plate are hollow.

3. The interconnecting member as claimed in claim 1 wherein each said projection in the plurality of projections on the first side of the plate is cone shaped.

4. The interconnecting member as claimed in claim 3 wherein the plurality of projections on the first side of the plate are aligned in a single row and are disposed between the pair of spaced-apart serrations.

5. The interconnecting member as claimed in claim 1 wherein each said projection in the plurality of projections on the second side of the plate is cone shaped.

6. The interconnecting member as claimed in claim 5 wherein the plurality of projections on the second side of the plate are aligned in two parallel rows.

7. The interconnecting member as claimed in claim 1 wherein the teeth are wedge shaped.

8. The interconnecting member as claimed in claim 1 wherein the end tooth is wedge shaped.

9. The interconnecting member as claimed in claim 1 wherein:

the plate is elongate;

the serrations each extend transversely along the first side of the plate;

the plurality of projections on the first side of the plate are aligned in a single row along a longitudinal axis of the plate; and the plurality of projections on the second side of the plate are aligned in two parallel rows aligned parallel to the longitudinal axis of the plate.

10. A sand or soil bag structure comprising:

a first sand or soil bag;

a second sand or soil bag; and an interconnecting member disposed between the first sand or soil bag and the second sand or soil bag, the interconnecting member having:

a plate with a first side and a second side, a first projection on the first side of the plate, a second projection on the second side of the plate, and a serration on the first side of the plate, the serration including a plurality of teeth arranged in a row and extending away from the plate in a first direction, and an end tooth disposed at an end of the row and extending away from the plate in a second direction which is opposite the first direction; and wherein the first projection on the first side of the plate engages the first sand or soil bag and the second projection on the second side of the plate engages the second sand or soil bag.

11. The sand or soil bag structure as claimed in claim 10 further including a geogrid which engages the end tooth on the first side of the plate.

12. An interconnecting member for a sand or soil bag comprising:

a plate having a first side and a second side;

a projection on the first side of the plate;

a projection on the second side of the plate; and a serration on the first side of the plate, the serration including a plurality of teeth arranged in a row and extending away from the plate in a first direction towards a first edge of the plate, and an end tooth disposed at an end of the row and extending away from the plate in a second direction towards a second edge of the plate which is opposite the first edge of the plate.

* * * * *